US006824446B1

(12) United States Patent
Ang et al.

(10) Patent No.: US 6,824,446 B1
(45) Date of Patent: Nov. 30, 2004

(54) METHOD AND APPARATUS FOR POLISHING AN OUTER EDGE RING ON A SEMICONDUCTOR WAFER

(75) Inventors: Boon Yong Ang, Cupertino, CA (US); Kenneth R. Harris, San Jose, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 377 days.

(21) Appl. No.: 09/974,241

(22) Filed: Oct. 10, 2001

Related U.S. Application Data

(62) Division of application No. 09/496,218, filed on Feb. 1, 2000, now Pat. No. 6,328,641.

(51) Int. Cl.[7] ..... B24B 1/00

(52) U.S. Cl. ..... 451/6; 451/10; 451/11; 451/44

(58) Field of Search ..... 451/6, 10, 11, 451/44, 41, 254, 258, 259

(56) References Cited

U.S. PATENT DOCUMENTS 4,344,260 A * 8/1982 Ogiwara
5,609,514 A * 3/1997 Yasunaga et al. ..... 451/65
5,658,189 A * 8/1997 Kagamida et al. ..... 451/66
5,821,164 A * 10/1998 Kim et al. ..... 438/633
6,068,539 A * 5/2000 Bajaj et al. ..... 451/6
6,074,287 A * 6/2000 Miyaji et al. ..... 451/287
6,267,649 B1 * 7/2001 Lai et al. ..... 451/44
6,475,293 B1 * 11/2002 Moinpour et al. ..... 134/6

* cited by examiner

*Primary Examiner*—Eileen P. Morgan
(74) *Attorney, Agent, or Firm*—Monica H. Choi

(57) ABSTRACT

An outer edge ring of a semiconductor wafer is polished to prevent delamination and peeling-off of at least one layer of material deposited near the outer edge of the semiconductor wafer during fabrication of integrated circuits. The semiconductor wafer is mounted on a wafer chuck, and the wafer chuck holding the semiconductor wafer is rotated such that the semiconductor wafer rotates. A polishing pad is moved toward the semiconductor wafer as the semiconductor wafer is rotating. The polishing pad has a polishing surface that faces and contacts the outer edge ring of the semiconductor wafer as the polishing pad is moved toward the semiconductor wafer to polish the outer edge ring of the semiconductor wafer. The outer edge ring has the at least one layer of material that is polished off by the polishing surface of the polishing pad. The polishing surface of the polishing pad may be tapered such that the edge of an upper layer of material that is disposed further from the semiconductor wafer is disposed more inward toward the center of the semiconductor wafer such that the upper layer of material is not likely to delaminate and peel-off away from a lower abutting layer of material on the semiconductor wafer. Furthermore, a photodetector may determine sufficient polishing of the outer edge ring of the semiconductor wafer.

13 Claims, 4 Drawing Sheets

METHOD AND APPARATUS FOR POLISHING AN OUTER EDGE RING ON A SEMICONDUCTOR WAFER

This is a divisional of an earlier filed patent application, with Ser. No. 09/496,218 filed on Feb. 1, 2000 U.S. Pat. No. 6,328 ,641, for which priority is claimed. This earlier filed copending patent application with Ser. No. 09/496,218 is in its entirety incorporated herewith by reference.

TECHNICAL FIELD

The present invention relates generally to fabrication of integrated circuits, and more particularly, to a method and apparatus for directly polishing an outer edge ring of a semiconductor wafer to prevent delamination of layers of material deposited on the outer edge ring of the semiconductor wafer during fabrication of integrated circuits thereon.

BACKGROUND OF THE INVENTION

FIG. 1 shows a typical shape of a semiconductor wafer 102 having integrated circuits fabricated thereon, as known to one of ordinary skill in the art of integrated circuit fabrication. During fabrication of integrated circuits on the semiconductor wafer 102, various layers of material are deposited onto the semiconductor wafer 102 on top of one another, as known to one of ordinary skill in the art of integrated circuit fabrication. Such layers of material however may delaminate and peel-off away from near the outer edge 103 of the semiconductor wafer 102, as known to one of ordinary skill in the art of integrated circuit fabrication. Such peeling of material away from near the outer edge 103 of the semiconductor wafer 102 creates a source of contaminants for the rest of the semiconductor wafer 102 which may render the integrated circuits fabricated on the semiconductor wafer inoperative.

A factor which may promote this undesired delamination and peeling off of layers of material away from near the outer edge 103 of the semiconductor wafer 102 are clamps which hold the semiconductor wafer 102 near the outer edge 103 of the semiconductor wafer 102. The semiconductor wafer 102 is held by clamping mechanisms within various integrated circuit fabrication equipment near the outer edge 103 of the semiconductor wafer 102.

Referring to FIG. 2A for example, a clamping ring 104 may hold the semiconductor wafer 102 all around the outer edge of the semiconductor wafer 102. (The dashed circle in FIG. 2A represents the circumference of the semiconductor wafer 102 held by the clamping ring 104.) FIG. 2B is the cross-sectional view of the clamping ring 104 holding the semiconductor wafer 102 across line I—I in FIG. 2A. Referring to FIG. 2B, the clamping ring 104 holds and covers an outer edge ring 106 all around the circumference of the semiconductor wafer 102.

Alternatively, referring to FIG. 3A, a plurality of clamping pins, including a first clamping pin 302, a second clamping pin 304, a third clamping pin 306, and a fourth clamping pin 308 holds the semiconductor wafer 102 at a plurality of positions near the outer edge of the semiconductor wafer 102. Typically, a higher number of clamping pins holds the semiconductor wafer 102 near the outer edge 103 of the semiconductor wafer 102, but four clamping pins 302, 304, 306, and 308 are shown in FIG. 3A for clarity of illustration. FIG. 3B is the cross-sectional view of the clamping pins 302 and 306 holding the semiconductor wafer 102 across line II—II in FIG. 3A. Referring to FIG. 3B, the clamping pins 302 and 306 hold and cover an outer edge distance 310 of the semiconductor wafer 102.

When either of the clamping ring 104 of FIG. 2A or the clamping pins 302, 304, 306, and 308 of FIG. 3A holds the semiconductor wafer 102 during deposition of material on the semiconductor wafer, such material is not deposited near the outer edge of the semiconductor wafer 102 held by the clamping ring 104 or the clamping pins 302, 304, 306, and 308. The semiconductor wafer 102 moves through multiple integrated circuit fabrication equipments typically for deposition of numerous layers of material. Because of misalignment of the semiconductor wafer 102 at the various integrated circuit fabrication equipments, these layers of material may delaminate and peel-off away from near the edge of the semiconductor wafer.

Referring to FIG. 4 for example, a first layer of material 402 is deposited on the semiconductor wafer 102 at a first integrated circuit fabrication equipment, a second layer of material 404 is deposited at a second integrated circuit fabrication equipment, and a third layer of material 406 is deposited at a third integrated circuit fabrication equipment. At each of many of these different integrated circuit fabrication equipments, a clamping ring or a plurality of clamping pins should hold the semiconductor wafer 102 at an outer edge distance 408 inward from the outer edge 103 of the semiconductor wafer.

Such an outer edge distance 408 is typically on the order of 4 mm (millimeters). Because of such a short distance and because the many fabrication equipments lack fine wafer alignment capability with respect to the clamping ring or the plurality of clamping pins, the misalignment of the semiconductor wafer 104 through the multiple integrated circuit fabrication equipments results in various extensions of the layers of materials into the outer edge distance 408.

Referring to FIG. 4, for example, the first layer of material 402 extends outward toward the outer edge 103 of the semiconductor wafer 102 beyond the outer edge distance 408. The second layer of material 404 extends outward even further than the first layer of material 402 toward the outer edge 103 of the semiconductor wafer beyond the outer edge distance 408. The third layer of material 406 is misaligned such that the third layer of material 406 extends inward toward the center of the semiconductor wafer 102 away from the outer edge distance 408.

Because of such misalignment of the multiple layers of material 402, 404, and 406, any of such layer of material 402, 404, and 406 may delaminate and peel-off away from near the outer edge 103 of the semiconductor wafer 102, as known to one of ordinary skill in the art of integrated circuit fabrication. For example, referring to FIG. 4, the second layer of material 404 hangs over the first layer of material 402 and beyond the third layer of material 406. Thus, the second layer of material 404 is likely to peel-off away from the semiconductor wafer 102. Such delamination and peeling-off of the misaligned layers of material are especially likely when abutting layers of material do not have strong adhesion.

Such peeling of material away from the edge of the semiconductor wafer may render the integrated circuits thereon inoperative. In addition, such peeling of material away from near the outer edge 103 of the semiconductor wafer 102 creates a source of contaminants for the rest of the semiconductor wafer 102 which may render the integrated circuits fabricated thereon inoperative. Such peeling of material away from near the outer edge 103 of the semiconductor wafer 102 may also contaminate integrated circuit fabrication equipment chambers during subsequent process steps. In the prior art, when a layer of material begins to peel away from the semiconductor wafer, the semiconductor wafer is reworked to remove the layer of material that is peeling away. However, such reworking of the semiconductor wafer is relatively complicated and time-consuming or in some cases very difficult. Alternatively, such a semiconductor wafer is scrapped which is a waste. Thus, a mechanism is desired for polishing the misaligned layers of material near the outer edge of the semiconductor wafer to efficiently and effectively prevent the delamination and peeling-off of the layers of material away from the semiconductor wafer during fabrication of integrated circuits thereon.

SUMMARY OF THE INVENTION

Accordingly, in a general aspect of the present invention, in an apparatus and method for polishing an outer edge ring of a semiconductor wafer, the semiconductor wafer is mounted on a wafer chuck. The semiconductor wafer has layers of material deposited thereon during fabrication of integrated circuits on the semiconductor wafer. The wafer chuck holding the semiconductor wafer is rotated such that the semiconductor wafer rotates. A polishing pad is moved toward the semiconductor wafer as the semiconductor wafer is rotating. The polishing pad has a polishing surface that faces and contacts the outer edge ring of the semiconductor wafer as the polishing pad is moved toward the semiconductor wafer to polish the outer edge ring of the semiconductor wafer. The layers of material deposited on the outer edge ring of the semiconductor wafer is polished offby the polishing surface of the polishing pad.

The present invention may be used to particular advantage when the polishing surface of the polishing pad is tapered such that an upper portion of the polishing surface that is to contact an upper layer of material disposed further away from the semiconductor wafer extends further toward the semiconductor wafer such that the polishing surface forms a taper angle with respect to a plane of the semiconductor wafer. The taper angle may be in a range of from about 30° to about 60°. Such a taper angle of the polishing pad ensures that the edge of an upper layer of material that is disposed further from the semiconductor wafer is disposed more inward toward the center of the semiconductor wafer such that the upper layer of material is not likely to delaminate and peel-off away from a lower abutting layer of material on the semiconductor wafer. The polishing surface may also be a rectangular shaped surface that faces and contacts a portion of the outer edge ring during polishing of the outer edge ring of the semiconductor wafer.

Furthermore, a photodetector may determine sufficient polishing of the outer edge ring of the semiconductor wafer. In that case, the polishing pad is moved away from the semiconductor wafer upon detection of sufficient polishing of the outer edge ring of the semiconductor wafer.

These and other features and advantages of the present invention will be better understood by considering the following detailed description of the invention which is presented with the attached drawings.

BRIEF DESCRIPTION OF THE DRAWINGS

The figures referred to herein are drawn for clarity of illustration and are not necessarily drawn to scale. Elements having the same reference number in FIGS. 1, 2, 3, 4, 5, 6, 7, 8, 9, and 10 refer to elements having similar structure and function.

DETAILED DESCRIPTION

Figure 5:
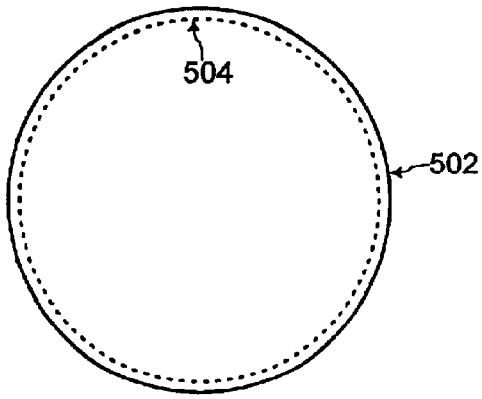
FIG. 5 shows an outer edge ring of the semiconductor wafer to be directly polished for preventing delamination and peeling-off of layers of material near the outer edge of the semiconductor wafer, according to an embodiment of the present invention.

For preventing delamination and peeling-off of layers of material away from the semiconductor wafer 102, an outer edge ring of the semiconductor wafer 102 is polished according to a general aspect of the present invention. Referring to FIG. 5, the outer edge ring of the semiconductor wafer 102 that is polished is defined as a ring area that has the outer edge circumference 502 of the semiconductor wafer 102 as the outer periphery of the ring and an inner circumference 504 (dashed circle in FIG. 5) as the inner periphery of the ring.

Figure 1:
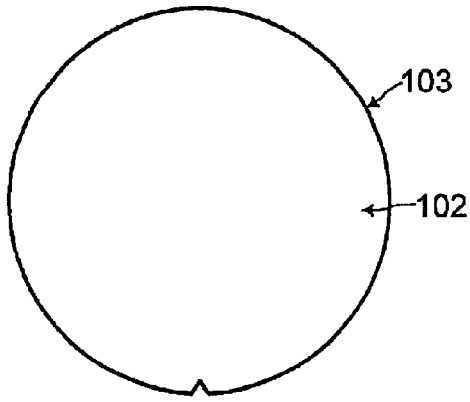
FIG. 1 (Prior Art)
FIG. 1 shows a typical shape of a semiconductor wafer as known in the prior art.
Figure 2A:
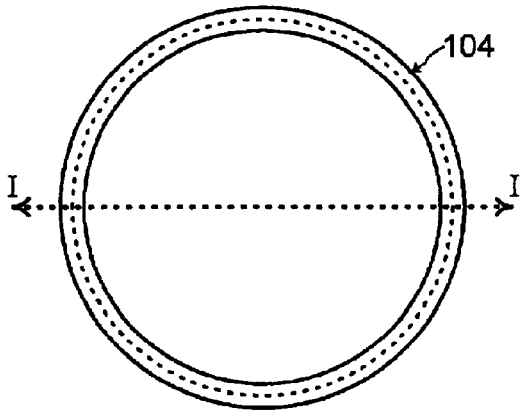
FIG. 2A (Prior Art)
FIG. 2A shows a top view of a clamping ring for holding a semiconductor wafer within an integrated circuit fabrication equipment.
Figure 2B:
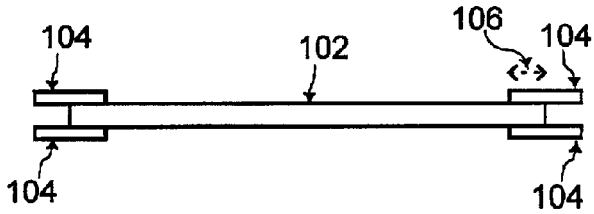
FIG. 2B (Prior Art)
FIG. 2B shows a cross-sectional view of the clamping ring of FIG. 2A holding the semiconductor wafer.
Figure 3A:
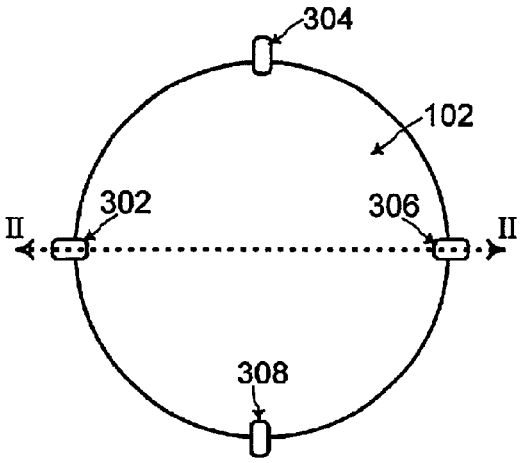
FIG. 3A (Prior Art)
FIG. 3A shows a top view of a plurality of clamping pins for holding a semiconductor wafer within an integrated circuit fabrication equipment.
Figure 3B:
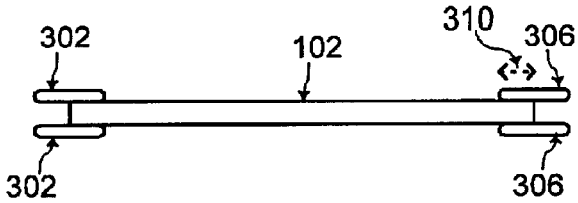
FIG. 3B (Prior Art)
FIG. 3B shows a cross-sectional view of the clamping pins of FIG. 3A holding the semiconductor wafer.
Figure 4:
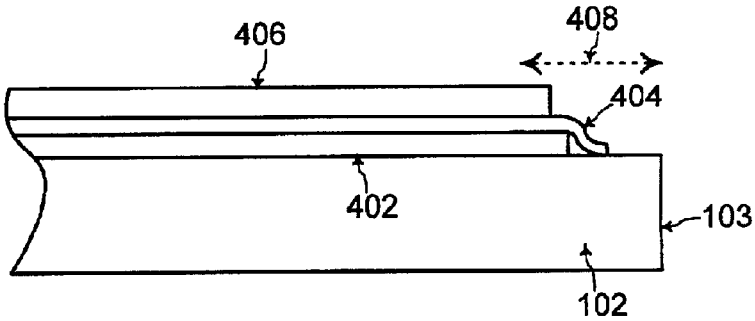
FIG. 4 (Prior Art)
FIG. 4 shows a cross-sectional view of multiple layers of material deposited on the semiconductor wafer in a misaligned manner near the outer edge of the semiconductor wafer.

Referring to FIGS. 2B, 3B, and 5, the distance between the outer circumference 502 and the inner circumference 504 may be determined by the dimension of the outer edge ring 106 held and covered by the clamping ring or the outer edge distance 310 held and covered by the plurality of clamping pins, for example. In that case, typically, the distance between the outer circumference 502 and the inner circumference 504 that is to be polished is designed to be greater than the dimension of the outer edge ring 106 held and covered by the clamping ring or the outer edge distance 310 held and covered by the plurality of clamping pins.

Figure 6:
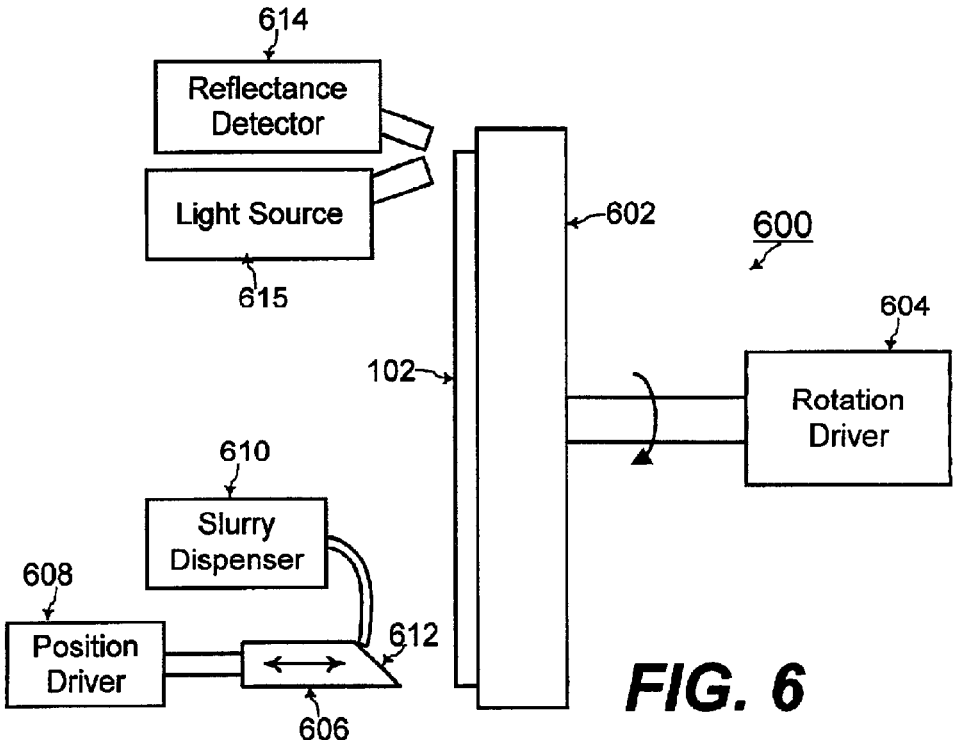
FIG. 6 shows a polishing system for polishing the outer edge ring of the semiconductor wafer of FIG. 5, according to an embodiment of the present invention.

Referring to FIG. 6, a polishing system 600 polishes the outer edge ring of the semiconductor wafer 102. In the polishing system 600, the semiconductor wafer 102 is mounted on a wafer chuck 602. The wafer chuck 602 is driven by a rotation driver 604 that rotates the wafer chuck 602 such that the semiconductor wafer 102 is rotated. The semiconductor wafer 102 is typically held to the wafer chuck 602 by vacuum suction. Such wafer chucks and rotation drivers are known to one of ordinary skill in the art of integrated circuit fabrication.

For polishing the outer edge ring of the semiconductor wafer 102, a polishing pad 606 is moved toward the rotating semiconductor wafer 102. The polishing pad 606 is coupled to a position driver 608 that moves the polishing pad 606 toward or away from the semiconductor wafer 102. Position drivers are known to one of ordinary skill in the art of mechanics. In a preferred embodiment of the present invention, a slurry dispenser 610 dispenses polishing slurry onto a polishing surface 612 of the polishing pad 606.

During operation of the polishing system 600, the position driver 608 moves the polishing pad 606 toward the semiconductor wafer 102 as the semiconductor wafer 102 is rotated on the wafer chuck 602. The polishing surface 612 of the polishing pad 606 is lined with a course material and faces toward the semiconductor wafer 102. As the polishing pad 606 is moved toward the semiconductor wafer, the polishing surface 612 eventually contacts the outer edge ring of the semiconductor wafer 102. Since the semiconductor wafer 102 is then spinning against the contacting polishing surface 612 of the polishing pad 606, the outer edge ring of the semiconductor wafer is polished by the polishing surface 612 of the polishing pad 606.

Referring to FIG. 6, in a preferred embodiment of the present invention, for further enhancing the polishing of the outer edge ring of the semiconductor wafer by the polishing surface 612, a slurry dispenser 610 dispenses polishing slurry onto the polishing surface 612. Polishing slurry is known to one of ordinary skill in the art of integrated circuit fabrication.

Further referring to the polishing system 600 of FIG. 6, a reflectance detector 614 detects for sufficient polishing of the outer edge ring of the semiconductor wafer 102. As the multiple layers of material are polished from the outer edge ring of the semiconductor wafer 102, a portion of the semiconductor wafer 102 is eventually reached during such polishing. The outer edge ring of the semiconductor wafer 102 is more shiny with a higher reflectance of light from a light source 615 at that time point. A reflectance detector 614 which includes a photodiode that measures change in reflectance of light from the outer edge ring detects for such a time point as an indicator of sufficient polishing of the outer edge ring of the semiconductor wafer 102. Because the outer edge ring of the semiconductor wafer 102 may be polished to a tapered shape, the light source 615 and the reflectance detector 614 are positioned at proper angles of travel of the reflected light.

Upon detection of sufficient polishing of the outer edge ring of the semiconductor wafer 102, the position driver 608 moves the polishing pad 606 away from the outer edge ring of the semiconductor wafer 102. The semiconductor wafer 102 is then dismounted from the wafer chuck 602 and is subject to a cleaning process for removing the polishing slurry and the polished-off material from the semiconductor wafer 102. For example, the semiconductor wafer 102 may be immersed in a bath of deionized water with ultrasonic vibration. Such cleaning processes are known to one of ordinary skill in the art of integrated circuit fabrication.

Figure 7:
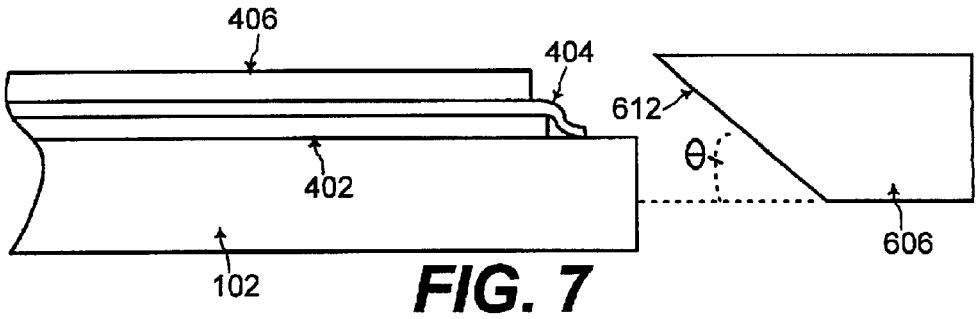
FIG. 7 shows a side view of a polishing pad of the polishing system of FIG. 6 having a tapered polishing surface, when the polishing pad is away from the semiconductor wafer, according to an embodiment of the present invention.

Referring to FIG. 7, in a preferred embodiment of the present invention, the polishing surface 612 of the polishing pad 606 is tapered. Thus, in FIG. 7, an upper portion of the polishing surface 612 that is to contact an upper layer of material disposed further away from the semiconductor wafer 102 extends further toward the semiconductor wafer. In this manner, the polishing surface 612 of the polishing pad 606 forms a taper angle θ with respect to a plane of the semiconductor wafer 102 (as shown in FIG. 7). In one embodiment of the present invention, the taper angle θ is in a range of from about 30° to about 60°.

Figure 8:
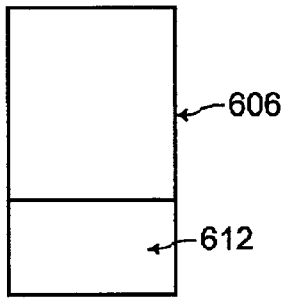
FIG. 8 shows a top view of the polishing pad of FIG. 7 having the polishing surface, according to an embodiment of the present invention.

Referring to FIG. 8, a top view of the polishing pad 606 having the polishing surface 612 is shown. In one embodiment of the present invention, the polishing surface 612 is a rectangular shaped surface that faces and contacts a portion of the outer edge ring at any given time during polishing of the outer edge ring of the semiconductor wafer 102. The whole outer edge ring of the semiconductor wafer 102 is polished as the semiconductor wafer 102 rotates against such a polishing surface 612 of the polishing pad 606.

Figure 9:
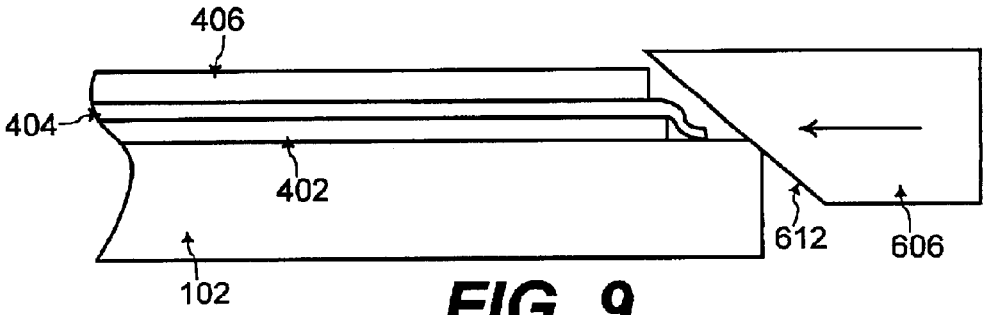
FIG. 9 shows a side view of the polishing pad of FIG. 7 when the polishing pad is moved toward the semiconductor wafer, according to an embodiment of the present invention.
Figure 10:
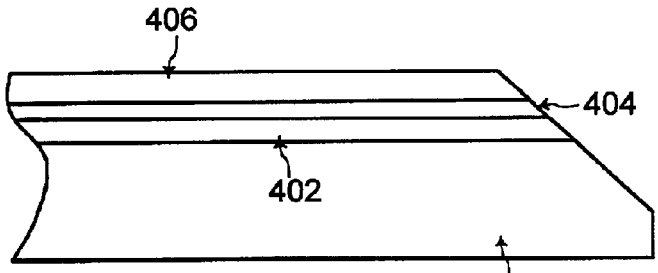
FIG. 10 shows the layers of material on the semiconductor wafer that have been polished with the polishing system of FIG. 6, according to an embodiment of the present invention.

Referring to FIG. 9, as the polishing pad 606 is moved toward the semiconductor wafer 102 and as the semiconductor wafer 102 rotates, the multiple layers of material 402, 404, and 406 and portions of the semiconductor wafer 102 are polished away from the outer edge ring of the semiconductor wafer 102 in accordance with the tapered shape of the polishing surface 612. FIG. 10 illustrates the shape of the multiple layers of material 402, 404, and 406 and the semiconductor wafer 102 after sufficient polishing of the outer edge ring of the semiconductor wafer 102.

Referring to FIGS. 9 and 10, because of the tapered shape of the polishing surface 612 of the polishing pad 606, the multiple layers of material 402, 404, and 406 and the semiconductor wafer 102 have been polished to a corresponding tapered shape. Such a tapered shape ensures that the edge of an upper layer of material that is further from the semiconductor wafer 102 extends more inward toward the center of the semiconductor wafer. Thus, the upper layer of material is completely supported by an abutting lower layer of material that is closer to the semiconductor wafer 102.

Referring to FIG. 10, for example, the third layer of material 406 is completely supported and abutted by the second layer of material 404. Similarly, the second layer of material 404 is completely supported and abutted by the first layer of material 402, and the first layer of material 402 is completely supported and abutted by the semiconductor wafer 102. Such support of each layer of material by the lower abutting layer of material further ensures that the layers of material are not likely to delaminate and peel-off away from the semiconductor wafer 102 to minimize contamination of the semiconductor wafer 102 during fabrication of integrated circuits thereon.

The foregoing is by way of example only and is not intended to be limiting. For example, the present invention may be used to particular advantage when layers of material peel from the outer edge ring of the semiconductor wafer for any reason, as would be apparent to one of ordinary skill in the art of integrated circuit fabrication from the description herein. For example, the outer edge ring may be formed by wafer edge exposure during photolithography processes (in addition to a clamping ring or clamping pins), as known to one of ordinary skill in the art. In such a photolithography process, photoresist is spun onto the semiconductor wafer, and an outer edge ring of the semiconductor wafer has a thicker layer of photoresist deposited thereon. Such thicker layer of photoresist is developed and etched from this outer edge ring of the semiconductor wafer. Furthermore, the shape of the polishing pad and the polishing surface are by way of example only, and the present invention may be advantageously practiced with other shapes of the polishing pad and the polishing surface.

The present invention is limited only as defined in the following claims and equivalents thereof.

We claim:

1. A method for polishing at an outer edge ring of a semiconductor wafer, the method including the steps of:

depositing at least one layer of material on the semiconductor wafer;

rotating the semiconductor wafer having the at least one layer of material deposited thereon;

moving a polishing pad toward the rotating semiconductor wafer such that a polishing surface of the polishing pad polishes at the outer edge ring of the semiconductor wafer, after the step of depositing the at least one layer of material; and orienting the polishing surface of the polishing pad to form a taper angle with respect to a plane of the semiconductor wafer such that the at least one layer of material at the outer edge ring of the semiconductor wafer is polished to have a tapered shape.

2. The method of claim 1, further including the steps of:

detecting sufficient polishing at the outer edge ring of the semiconductor wafer; and moving the polishing pad away from the semiconductor wafer upon detection of sufficient polishing at the outer edge ring of the semiconductor wafer.

3. The method of claim 2, wherein the step of detecting sufficient polishing is performed using a photo-detector that measures change in reflectance of light from the outer edge ring of the semiconductor wafer.

4. The method of claim 1, further including the step of:

dispensing a polishing slurry onto the polishing surface of the polishing pad.

5. The method of claim 1, wherein the taper angle is in a range of from about 30° to about 60°.

6. The method of claim 1, wherein the polishing surface is a rectangular shaped surface that contacts the outer edge ring during polishing at the outer edge ring of the semiconductor wafer.

7. The method of claim 1, further including the step of:

cleaning the semiconductor wafer after sufficient polishing at the outer edge ring of the semiconductor wafer.

8. The method of claim 1, further comprising:

depositing a plurality of layers of material on the semiconductor wafer before the step of polishing at the outer edge ring of the semiconductor wafer;

wherein after the step of polishing, the plurality of layers are formed into the tapered shape at the outer edge of the semiconductor wafer such that each layer of material is completely supported by an abutting lower layer of material.

9. The method of claim 8, further including the steps of:

detecting sufficient polishing at the outer edge ring of the semiconductor wafer; and moving the polishing pad away from the semiconductor wafer upon detection of sufficient polishing at the outer edge ring of the semiconductor wafer.

10. The method of claim 9, wherein the step of detecting sufficient polishing is performed using a photo-detector that measures change in reflectance of light from the outer edge ring of the semiconductor wafer.

11. The method of claim 8, further including the step dispensing a polishing slurry onto the polishing surface of the polishing pad.

12. The method of claim 8, wherein the polishing surface is a rectangular shaped surface that contacts the outer edge ring during polishing at the outer edge ring of the semiconductor wafer.

13. The method of claim 8, further including the step cleaning the semiconductor wafer after sufficient polishing at the outer edge ring of the semiconductor wafer.

* * * * *